US007246658B2

(12) United States Patent
Wyatt et al.

(10) Patent No.: US 7,246,658 B2
(45) Date of Patent: Jul. 24, 2007

(54) METHOD AND APPARATUS FOR EFFICIENT HEAT EXCHANGE IN AN AIRCRAFT OR OTHER VEHICLE

(75) Inventors: William Gerald Wyatt, Plano, TX (US); James L. Haws, McKinney, TX (US); Richard M. Weber, Prosper, TX (US)

(73) Assignee: Raytheon Company, Waltham, MA (US)

( * ) Notice: Subject to any disclaimer, the term of this patent is extended or adjusted under 35 U.S.C. 154(b) by 123 days.

(21) Appl. No.: 10/698,269

(22) Filed: Oct. 31, 2003

(65) Prior Publication Data

US 2005/0092481 A1 May 5, 2005

(51) Int. Cl.
*B64D 13/00* (2006.01)
*F28B 11/00* (2006.01)

(52) U.S. Cl. ..... 165/274; 165/41; 165/44; 165/301; 165/302; 165/110; 165/163; 165/122; 244/57

(58) Field of Classification Search ..... 165/274, 165/301, 302, 110, 111, 112, 113, 41, 44, 165/122, 163; 244/57
See application file for complete search history.

(56) References Cited

U.S. PATENT DOCUMENTS 1,906,422 A * 5/1933 Roulton ..... 165/302
2,158,858 A * 5/1939 Hoffmann ..... 165/44
2,168,166 A * 8/1939 Larrecq ..... 244/57
2,371,443 A * 3/1945 Hillier ..... 122/451 R
2,447,486 A * 8/1948 Burke, Jr. ..... 244/57
4,129,180 A * 12/1978 Larinoff ..... 165/113
4,301,861 A * 11/1981 Larinoff ..... 165/110
5,067,560 A * 11/1991 Carey et al. ..... 165/124
5,181,395 A * 1/1993 Carpenter et al. ..... 165/110
5,950,717 A * 9/1999 Fay ..... 165/113

* cited by examiner

*Primary Examiner*—John K. Ford
(74) *Attorney, Agent, or Firm*—Baker Botts L.L.P.

(57) ABSTRACT

A heat exchanger extracts heat from a two-phase fluid coolant so that the coolant changes from a vapor state to a liquid state. Two valves have respective inlets which communicate with the coolant in the heat exchanger, and which are physically spaced from each other. Valve control structure responds to the presence of liquid at the inlet to either valve by opening that valve, so that the liquid coolant flows through the valve to a discharge section. A different feature involves a housing with a heat exchanger therein, the heat exchanger having a plurality of coolant conduits that are axially spaced. A flow of air travels axially within the housing, then flows transversely past the conduits to the other side thereof, and then resumes flowing axially on the other side of the conduits.

11 Claims, 3 Drawing Sheets

METHOD AND APPARATUS FOR EFFICIENT HEAT EXCHANGE IN AN AIRCRAFT OR OTHER VEHICLE

TECHNICAL FIELD OF THE INVENTION

This invention relates in general to heat exchangers and, more particularly, to a heat exchanger suitable for use in a vehicle such as aircraft.

BACKGROUND OF THE INVENTION

There are a variety of applications in which a heat exchanger is used to transfer heat from one medium (such a coolant) to another medium (such as an airflow). As one example, an aircraft may have a phased array antenna system which is cooled using a coolant, where the coolant is then routed through a heat exchanger that extracts heat from the coolant. While existing heat exchangers have been generally adequate for their intended purposes they have not been satisfactory in all respects.

More specifically, vehicle movement, such as the pitch and roll of an aircraft, can make it difficult to ensure that, in the case of a two-phase coolant, the coolant leaving the heat exchanger is primarily liquid coolant and contains little or no vapor coolant. A further consideration is that a heat exchanger should be lightweight and compact, especially in an airborne application. However, this often means that the heat exchanger is configured so that the air passes successively through several sets of coils or fins, which collectively produce a relatively high pressure drop between the inlet and outlet of the heat exchanger. Where a fan is used to facilitate this air flow, the relatively high pressure drop means that the fan needs a relatively high amount of input power in order to generate a suitable airflow, and this level of power consumption is undesirable in an airborne application.

Still another consideration is that different applications need heat exchangers that have different capacities, and a heat exchanger developed for one application cannot be easily reconfigured to have a different capacity suitable for a different application.

SUMMARY OF THE INVENTION

From the foregoing, it may be appreciated that a need has arisen for a heat exchanger which avoids at least some of the disadvantages of pre-existing heat exchangers. According to the present invention, a method and apparatus are provided to address this need.

One form of the invention relates to a heat exchanger which includes a conduit with a thermally conductive portion disposed between a first portion and a second portion, where the second portion is vertically lower than the first portion, which includes thermally conductive structure with a portion thermally coupled to the thermally conductive portion of the conduit, and which includes first and second valves that each have an inlet and an outlet, the inlets of the valves being physically spaced from each other in a predetermined direction and each being in fluid communication with the second portion of the conduit. This form of the invention involves: supplying to the first portion of the conduit a fluid coolant, at least a portion of the coolant being in a vapor state; causing at least a portion of the coolant to flow from the first portion of the conduit through the thermally conductive portion thereof to the second portion thereof, the portion of the thermally conductive structure receiving heat from coolant in the thermally conductive portion of the conduit so that coolant in a vapor state is cooled and changes to a liquid state; responding to the presence of coolant in a liquid state at the inlet to either valve by opening that valve; and delivering coolant from the outlet of each valve to a discharge section.

A different form of the invention relates to an elongate housing extending approximately in an axial direction, and having therein a heat exchanger with a plurality of coolant conduits which are spaced from each other in the axial direction, which each extend approximately transversely to the axial direction, and which each have structure thereon for facilitating a transfer of heat from the conduit to air adjacent thereto. This form of the invention involves: causing a flow of air to travel within the housing in the first direction on one side of the conduits; causing the air to thereafter flow past the conduits to the other side thereof approximately perpendicular to the axial direction and the conduits; and causing the air to then resume flowing in the axial direction within the housing on the other side of the conduits.

BRIEF DESCRIPTION OF THE DRAWINGS

A better understanding of the present invention will be realized from the detailed description which follows, taken in conjunction with the accompanying drawings, in which.

DETAILED DESCRIPTION

Figure 1:
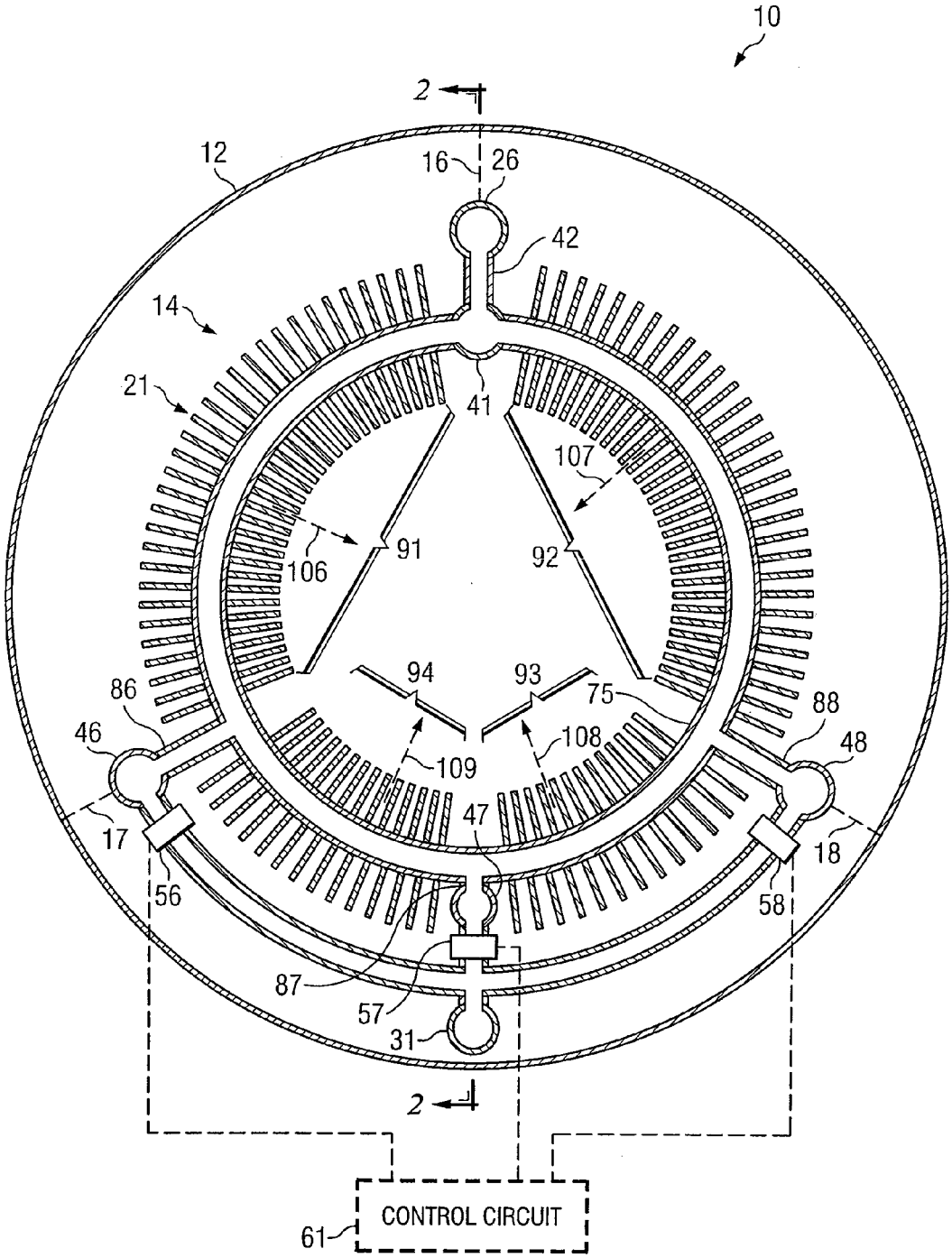
FIG. 1 is a diagrammatic sectional front view of an apparatus which includes a heat exchanger that embodies aspects of the present invention.
Figure 2:
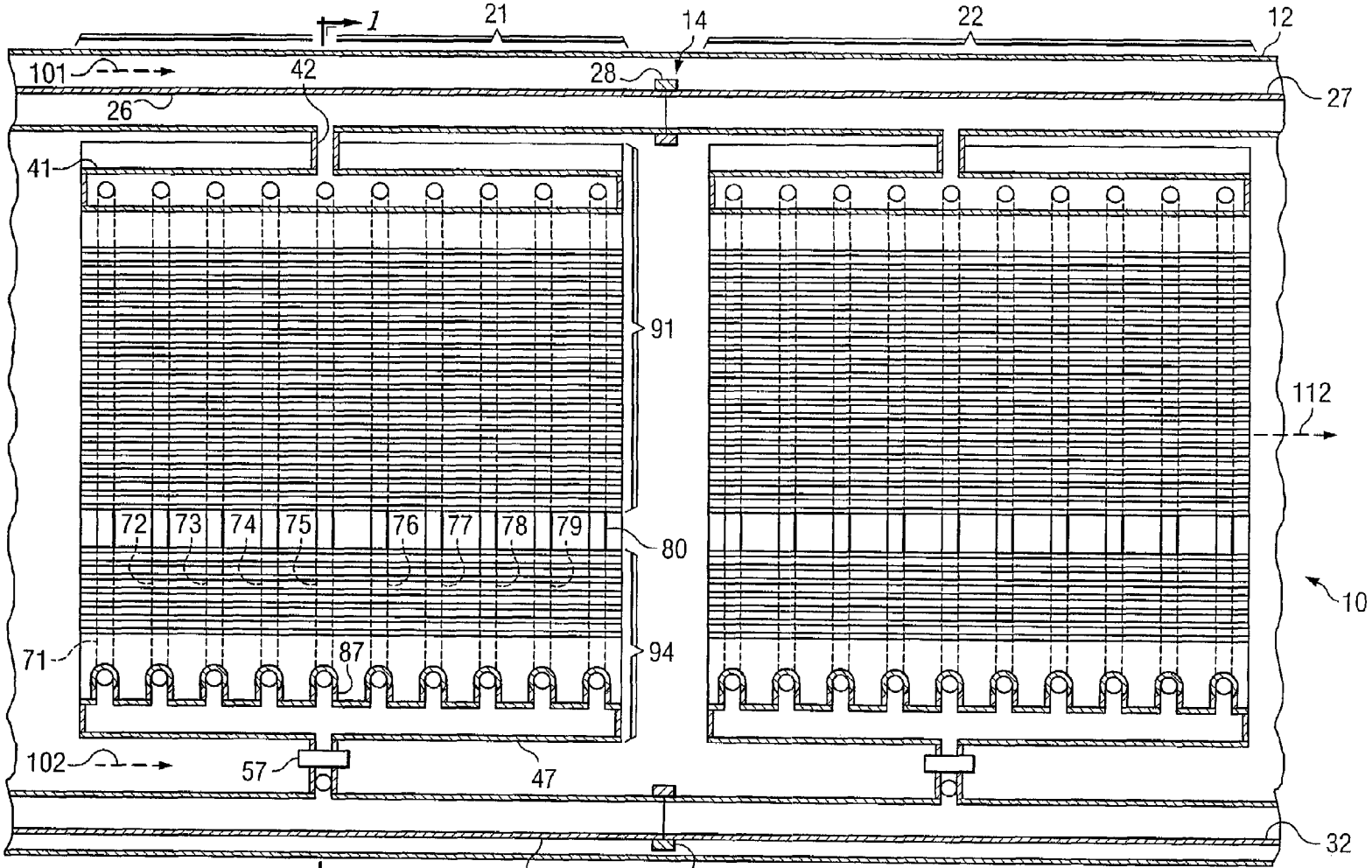
FIG. 2 is a diagrammatic fragmentary sectional side view taken along the section line 2-2 in FIG. 1.

FIG. 1 is a diagrammatic sectional front view of an apparatus 10 which embodies aspects of the present invention. FIG. 2 is a diagrammatic fragmentary sectional side view of the apparatus 10, taken along the section line 2-2 in FIG. 1. FIG. 2 also includes a section line 1-1, indicating how the view of FIG. 1 relates to the view of FIG. 2.

The apparatus 10 includes an elongate cylindrical housing 12. In the disclosed embodiment, the housing 12 is a pre-existing component of a type commonly found on a military aircraft, and is often referred to as a "pod". One such existing pod has a standardized internal diameter of 28", but the present invention is not limited to any particular size housing. Further, although the present invention is advantageous for airborne applications, it is not limited to that specific context, and the housing 12 could alternatively be any other suitable type of housing.

The apparatus 10 includes a heat exchanger 14 provided within the housing 12. The structure which supports the heat exchanger 14 is not shown in detail in the drawings, but is indicated diagrammatically in FIG. 1 by three broken lines at 16, 17 and 18.

As best seen in FIG. 2, the heat exchanger 14 includes a plurality of identical sections or modules which are provided at axially spaced locations along the housing, and two of these modules are shown at 21 and 22 in FIG. 2. The modules 21 and 22 include respective sections 26 and 27 of an axially extending coolant supply line. The sections 26 and 27 are sealingly coupled by a fitting 28. Further, the modules 21 and 22 include respective sections 31 and 32 of an axially extending coolant discharge or return line. The sections 31 and 32 are sealingly coupled by a fitting 33.

As mentioned above, the modules of the heat exchanger 14 are all substantially identical. Therefore, only the module 21 will be described here in detail. With reference to FIG. 1, the module 21 includes a supply manifold 41, which extends axially and is disposed a small distance below the supply line section 26. A short vertical tube 42 provides fluid communication between the middle of the supply line section 26, and the middle of the supply manifold 41.

The module 21 includes three collection manifolds 46-48 which each extend axially, and which are provided at angularly offset locations. The module 21 also has three valves 56-58, which each include an electrically-operated valve with an inlet and an outlet, along with an electronic sensor that can detect the presence of liquid coolant at the inlet to the valve. Each of these sensors is electrically coupled to a control circuit, which is shown diagrammatically at 61, and which electrically controls each of the valves. The inlet of each of the valves 56-58 is in fluid communication with the central portion of a respective one of the collection manifolds 46-48. The outlet of each of the valves 56-58 is in fluid communication with the discharge line section 31 of the module 21.

Although the valves 56-58 are each electrically operated, and each have an electrical sensor, it would alternatively by possible to use some other type of sensor and valve. For example, a mechanical arrangement could be provided to sense liquid coolant and to then mechanically open the associated valve.

With reference to FIGS. 1 and 2, the module 21 includes ten approximately circular conduits 71-80, which are provided at axially spaced locations. Each of the conduits 71-80 is made of a thermally conductive material. The upper central portion of each conduit communicates with the coolant supply manifold 41 on opposite sides of the manifold 41. Three short radially-extending tubes 86-88 provide fluid communication between the circular conduit 75 and the respective collection manifolds 46-48. Each of the other conduits 71-74 and 76-80 communicates through three similar tubes with the collection manifolds 46-48.

The module 21 of the heat exchanger 14 includes four groups 91-94 of thermally conductive fins. The fins each extend axially and radially, and the circular conduits 71-80 each extend through a respective opening in each fin, and are each thermally coupled to each fin.

The apparatus 10 of FIGS. 1-2 operates in the following manner. A coolant absorbs heat in some remote and not-illustrated device, and then is supplied to the heat exchanger 14 through the coolant supply line which includes the sections 26 and 27. In the disclosed embodiment, the fluid coolant is a two-phase coolant, which can be in either a liquid state or a vapor state. Typically, most or all of the coolant flowing through the coolant supply line is in its vapor state, due to the heat absorbed by the coolant.

A variety of different coolants can be used in the disclosed embodiment, including but not limited to water, methanol, a fluorinert, a mixture of water and methanol, or a mixture of water and ethylene glycol (WEGL). Of these, water absorbs the most heat as it vaporizes, or in other words has the highest latent heat of vaporization. In applications where the coolant would not be subjected to freezing temperatures, water is a good choice. But as mentioned above, the embodiment of FIGS. 1-2 was developed for an airborne application, where temperatures at high altitudes can be very cold. Therefore, in order to lower the freezing temperature of the coolant for that type of application, one suitable choice for the coolant is a mixture of water and ethylene glycol (WEGL), which has a lower freezing temperature than pure water.

A further consideration regarding the coolant is that, at a normal atmospheric pressure of 14.7 psia, pure water boils at a temperature of 100° C., and a mixture of water and ethylene glycol also boils at a relatively high temperature. Consequently, in certain portions of the cooling loop, the coolant is maintained at a subambient pressure of about 3 psia, which decreases the boiling temperature of pure water to approximately 60° C., and effects a comparable decrease in the boiling temperature of WEGL. This helps the coolant to boil and vaporize at a lower temperature than would otherwise be the case, and thus to absorb substantial amounts of heat at a lower temperature than would otherwise be the case. Although the disclosed embodiment uses a coolant which is at a subambient pressure in part of the cooling loop, it would alternatively be possible to use the heat exchanger of FIGS. 1-3 with the coolant at some other pressure, which need not be a subambient pressure.

With reference to the module 21, heated coolant is supplied to the supply line section 26. In the case of the two-phase WEGL coolant discussed above, most of this coolant will normally be in its vapor state, but a portion may be in its liquid state. This coolant flows from the supply line section 26 through the tube 42 to the supply manifold 41, where it is distributed to the upper portion of each of the circular conduits 71-80. Coolant then flows downwardly on both sides of each of the circular conduits, to the lower portion of each conduit. As this occurs, heat from the coolant is transferred through the walls of the conduit to the fins in each of the groups of fins 91-94. As the coolant gives up heat in this manner, it changes from a vapor back to a liquid. Various forces such as gravity act on the resulting liquid coolant, and these forces are sometimes referred to collectively as an acceleration vector. In response to these forces, including gravity, the resulting liquid coolant collects in one or more of the collection manifolds 46-48.

As mentioned above, the valves 56-58 each include a sensor which detects whether liquid coolant is present at the inlet to that valve, and the control circuit 61 opens that valve when there is liquid present at its inlet, thereby allowing the liquid coolant to flow through the valve and into the section 31 of the discharge line. When the coolant present at the inlet to any of the valves 56-58 is in its vapor state rather than its liquid state, the control circuit 61 keeps that particular valve closed in order to restrict the extent to which vapor coolant can enter the section 31 of the discharge line. The vapor coolant will give up heat over time, and eventually condense back into its liquid state, and can then pass through one of the valves.

As discussed above, the disclosed embodiment was designed so that it would be suitable for use on an aircraft. When the aircraft is experiencing a degree of roll about its longitudinal axis, for example when the aircraft is banking left or right, the housing 12 and the heat exchanger 14 in it will tend to rotate clockwise or counterclockwise in FIG. 1 about the lengthwise axis of the housing 12. This is why the three tubes 86-88 in FIG. 1 communicate with the circular conduit 75 at angularly spaced locations. For example, if the aircraft banks in one direction, the collection manifold 46 may be the vertically lowest of the three collection manifolds 46-48, such that liquid coolant collects there first. Alternatively, if the aircraft banks in the opposite direction, the collection manifold 48 may be the vertically lowest of the three collection manifolds 46-48, such that liquid coolant collects there first. Thus, at any given point in time, and regardless of the current orientation of the aircraft, at least one of the valves 56-58 will normally be able to remove liquid coolant from the heat exchanger, thereby avoiding intervals of time during which no liquid coolant can be removed from the heat exchanger. The angular spacing of the collection manifolds 46-48 thus permits the heat exchanger 14 to operate efficiently and effectively in a continuous manner, despite most normal banking maneuvers of the aircraft in which it is installed.

A further consideration is that, when the aircraft undergoes a change in pitch about a transverse horizontal axis, for example when the aircraft is climbing or diving, the housing 12 and the heat exchanger 14 will effectively experience a limited amount of clockwise or counterclockwise rotation about an axis perpendicular to the plane of FIG. 2. If each module of the heat exchanger 14 did not have its own collection manifolds, such as that at 47 in FIG. 2, or in other words if there was a single collection manifold extending the entire length of the heat exchanger 14, all liquid coolant reaching the single collection manifold would tend to flow to one of the two axial ends of the single collection manifold. As a result, valves at that end of the single manifold would typically not have an operational capacity sufficient to handle all of the liquid coolant trying to exit the entire heat exchanger, while valves at the center and opposite end of the heat exchanger would not have access to the liquid coolant and thus would be effectively useless. In contrast, since the disclosed embodiment has at least one separate collection manifold in each of the axially-spaced modules, the ability of liquid coolant to flow axially within any collection manifold is restricted, and the valves in each module have an effectively equivalent opportunity to handle liquid coolant, even when the aircraft is climbing or diving.

A flow of air is supplied to the front end of the housing 12, either by a fan, or through an opening to the atmosphere which produces a ram effect when the aircraft is moving. A not-illustrated baffle guides this incoming air so that it initially flows axially through the housing 12 adjacent the inner surfaces of the housing, and radially outwardly of the fin groups 91-94. This is indicated diagrammatically in FIG. 2 by the arrows 101 and 102. In the region of each of the modules, a respective portion of this air will turn and flow radially inwardly through the fins of the fin groups 91-94 of that module, as indicated diagrammatically in FIG. 1 by the arrows 106-109. After passing through the fins, the air then turns again and flows axially and rearwardly in approximately the center of the housing, as indicated diagrammatically by arrow 112 in FIG. 2.

It should be noted that, in the embodiment of FIGS. 1-2, the air traveling through the housing 12 does not pass successively through several sets of fins disposed at axially spaced locations. If it did, then there would be a relatively high pressure drop between the beginning and end of the air flow, which in turn would make it necessary to supply a relatively high amount of input power to the fan which generates the air flow. But in the embodiment of FIGS. 1-2, since any given portion of the air flow passes through only one group of fins during its travel along the entire length of the housing, the air flow has a very low pressure drop from the inlet to the outlet of the housing 12. This permits a fan driving this airflow to use a relatively nominal amount of power, which is advantageous.

Figure 3:
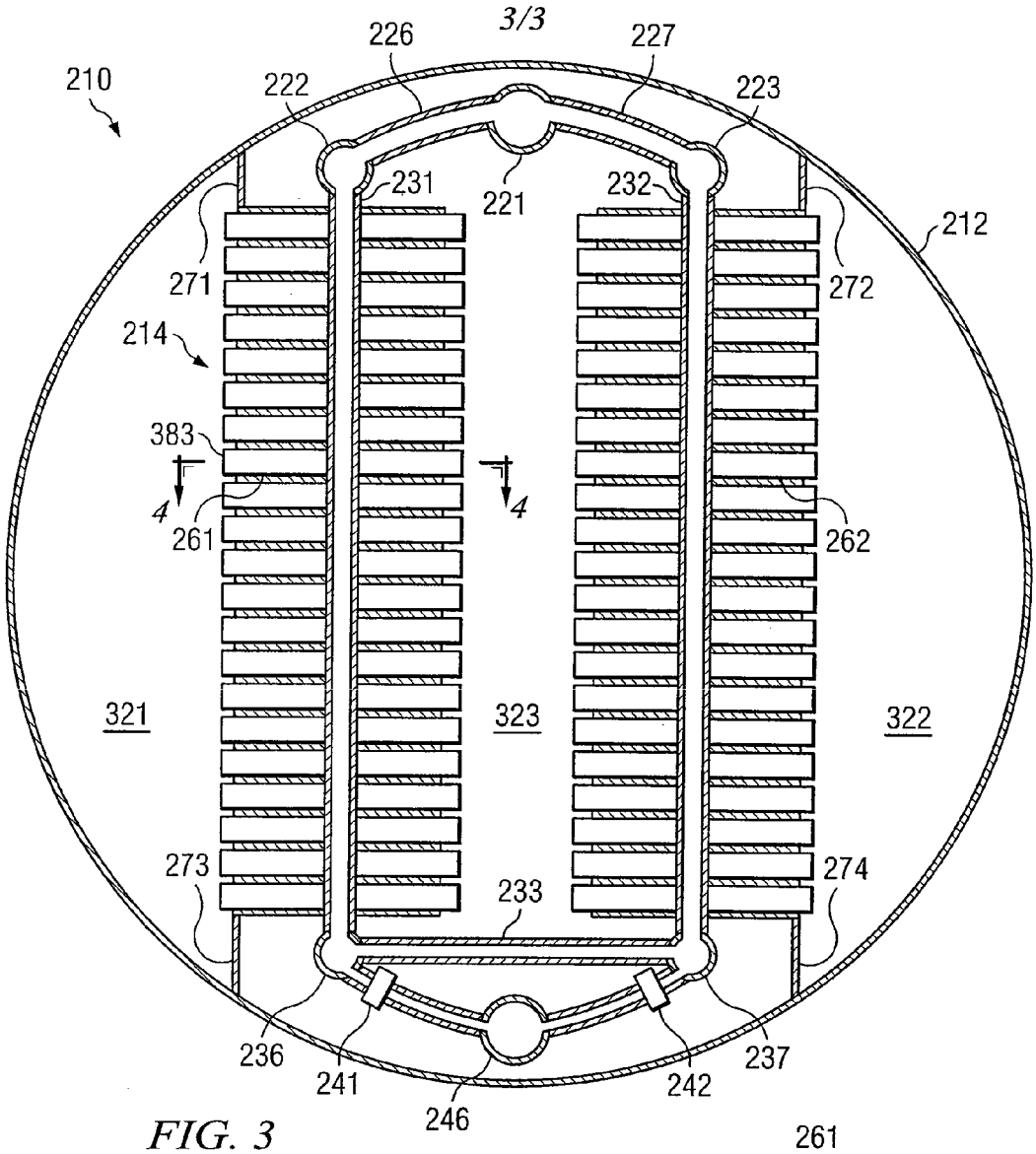
FIG. 3 is a diagrammatic sectional front view of a further apparatus which embodies aspects of the present invention, and which is an alternative embodiment of the apparatus of FIG. 1.

FIG. 3 is a diagrammatic sectional front view of an apparatus 210 which is an alternative embodiment of the apparatus 10 of FIG. 1. The apparatus 210 includes a housing 212, which is effectively identical to the housing 12 in the embodiment of FIG. 1. The apparatus 210 further includes a heat exchanger 214 disposed within the housing 212. The heat exchanger 214 includes a plurality of axially spaced modules, in a manner analogous to the modules in the embodiment of FIGS. 1-2.

The heat exchanger 214 includes a coolant supply line 221, which extends substantially the entire length of the heat exchanger 214. Each module of the heat exchanger includes a respective section of the coolant supply line 221, and the adjacent ends of these sections are sealingly coupled by respective fittings. Each module includes two supply manifolds 222-223, which are horizontally spaced, and which each communicate with the supply line 221 through a respective tube 226 or 227.

Each module of the heat exchanger 214 includes ten U-shaped conduits, one of which is visible in FIG. 3 at 231-233. In particular, this conduit includes a vertical portion 231 which communicates at its upper end with the supply manifold 222, a vertical portion 232 which communicates at its upper end with the supply manifold 223, and a horizontal portion 233 which extends between the lower ends of the vertical portions 231 and 232. Each module includes two collection manifolds 236 and 237, which extend axially and are horizontally spaced. Each collection manifold communicates with each of the ten conduits at the intersection between the horizontal portion 233 and a respective one of the vertical portions 231 and 232.

As discussed above, each of the conduits in the embodiment of FIG. 3 has a horizontal portion 233 which extends between the two vertical portions 231 and 232 thereof. Stated differently, each module has ten of the horizontal portions 233 extending between the collection manifolds 236 and 237. However, it would alternatively be possible for each module to have a smaller number of the horizontal portions 233 extending between the collection manifolds 236 and 237. For example, nine of the horizontal portions 233 could be omitted in each module, so that each module would have ten of the vertical portions 231, ten of the vertical portions 232, but only one of the horizontal portions 233.

In the embodiment of FIG. 3, each module includes two valves, for example as shown 241 and 242. The valves 241 and 242 each include an electrically operated valve with an inlet and outlet, and an electrical liquid sensor disposed at the inlet to the valve. The valves 241 and 242 are each coupled to a not-illustrated control circuit, which is comparable to the control circuit shown at 61 in FIG. 1. The inlet of each valve 241 and 242 is in fluid communication with a respective one of the collection manifolds 236 and 237. The outlet of each valve 241 and 242 is in fluid communication with a discharge line 246. The discharge line 246 extends substantially the entire length of the heat exchanger 214. Each of the modules of the heat exchanger includes a respective section of the coolant discharge line 246, and the adjacent ends of these sections are sealingly coupled by respective fittings.

Each module includes two groups of thermally conductive fins that each extend horizontally and axially, where reference numeral 261 in FIG. 3 designates a fin in one group, and reference numeral 262 designates a fin in the other group. Each of the ten U-shaped conduits in each module has one of its vertical portions extending through a respective opening in each of the fins of one group, and its other vertical portion extending through a respective opening in each of the fins of the other group. Each fin is thermally coupled to each conduit that extends through it. Each module has two walls 271 and 272 that each extend upwardly to the housing 212 from the outermost end of the uppermost fin of a respective fin group. Further, each module has two walls 273 and 274 that each extend downwardly to the housing 212 from the outermost edge of the lowermost fin of a respective fin group.

Figure 4:
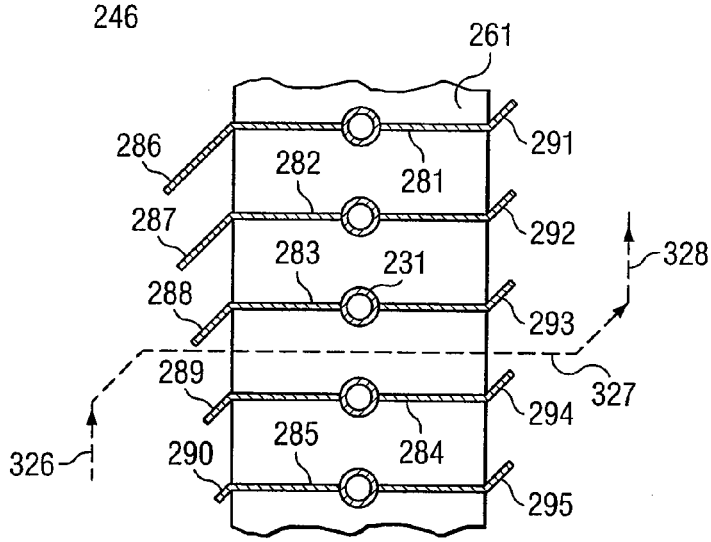
FIG. 4 is a diagrammatic fragmentary sectional view taken along the section line 4-4 in FIG. 3.

FIG. 4 is a diagrammatic fragmentary sectional view taken along the section line 4-4 in FIG. 3. With reference to FIGS. 3 and 4, ten vanes are provided between each pair of adjacent fins within each group of fins. Five of these vanes are visible at 281-285 in FIG. 4. The vanes 281-285 are each made of metal, and thus are thermally conductive. Each conduit in the module has one of its vertical portions extending through the center of a respective vane. The outer end of each vane has a respective bent portion 286-290, which is inclined somewhat toward the front of the housing, and it will be noted that these bent portions increase progressively in length in a direction from the front of the module toward the rear. The inner ends of the vanes also have respective bent portions 291-295 which are of approximately equal length, and which are inclined somewhat toward the rear of the housing.

The embodiment of FIGS. 3-4 operates in a manner generally similar to that described above for the embodiment of FIGS. 1-2. The following discussion will therefore focus primarily on some differences. Coolant is supplied to the heat exchanger 214 through the supply line 221, where most or all of this coolant is typically in a vapor state. Within each module of the heat exchanger, coolant flows through the tubes 226 and 227 to the supply manifolds 222 and 223. Coolant flows from the supply manifold 222 into the vertical portion 231 of each of the ten conduits in that module, and flows from the supply manifold 223 into the vertical portion 232 of each of the ten conduits in that module. As the coolant flows downwardly through the vertical portions 231 and 232 of each conduit, heat is transferred to the associated fins, including those shown at 261 and 262. As the coolant gives up heat, it condenses from its vapor state back to its liquid state.

After passing through the vertical sections 231 and 232, the coolant collects in one or more of the collection manifolds 236-237, which communicate with each other through the horizontal portions 233 of the ten conduits. Each of the valves 241 and 242 opens when it detects liquid coolant at its inlet, such that liquid coolant is supplied from the collection manifolds 236-237 in each module to the discharge line 246.

Air is supplied to one end of the housing 212, and a not-illustrated baffle causes the air to initially flow axially within the housing on opposite sides of the heat exchanger 214, or in other words within the spaces shown at 321 and 322 in FIG. 3, and in the direction indicated by arrow 326 in FIG. 4. With reference to FIG. 4, the end portions 286-290 of the vanes 281-285 help to redirect a portion of this airflow at each module, so that air flows between the vanes and the fins in a transverse direction which is approximately perpendicular to the axial direction in which the air was flowing, as indicated by arrow 327. It will be noted that the vane end portions 286-290 increase progressively in length in a direction from the front to the rear of the module, in order to facilitate this redirection of a respective portion of the airflow by each of the vanes. At the opposite ends of the vanes 281-285, the end portions 291-295 help redirect the airflow again, so that as indicated by an arrow 328 it travels axially toward the rear of the housing, within the region 323 (FIG. 3) disposed between the two sets of fins in each module. It will be noted that the walls 271-274 help to ensure that the air flows between the fins and vanes, rather than above or below either group of fins.

The present invention provides a number of advantages. One such advantage results from the provision of a heat exchanger with structure that facilitates the removal of liquid coolant without any significant escape of vapor coolant. A related advantage is that this removal of liquid but not vapor coolant can be effected reliably, even when the heat exchanger is mounted in a moving vehicle such as an aircraft, where the vehicle movement influences the flow of liquid coolant. A further advantage results from configuring the heat exchanger to include two or more modular units that are effectively identical, such that the heat exchange capacity of a heat exchanger can be easily adjusted by varying the number of modules utilized to construct that heat exchanger.

Still another advantage is that the heat exchanger is configured so that there is a very low pressure drop for the air passing through it. Where a fan is used to generate this airflow, the low pressure drop means that the fan operates with a relatively low amount of input power, which is advantageous for a variety of applications. As one example, it is advantageous when the heat exchanger is mounted in an aircraft, where excess power consumption by a fan is undesirable. A further advantage is that the disclosed embodiment achieves this low pressure drop while simultaneously providing a high rate of heat transfer from the coolant to the air flowing through the heat exchanger. Further, the disclosed heat exchanger is compact and relatively light in weight.

Although selected embodiments have been illustrated and described in detail, it will be understood that various substitutions and alterations are possible without departing from the spirit and scope of the present invention, as defined by the following claims.

What is claimed is:

1. An apparatus comprising:

an aircraft operable to roll; and a heat exchanger operable to perform heat exchange for the aircraft, the heat exchanger including:

a conduit having spaced first and second portions and a thermally conductive portion disposed therebetween, said second portion being vertically lower than said first portion;

a supply section for supplying to said first portion of said conduit a fluid coolant, at least a portion of the coolant being in a vapor state, and at least a portion of the coolant flowing from said first portion of said conduit through said thermally conductive portion thereof to said second portion thereof;

thermally conductive structure having a portion which is thermally coupled to said thermally conductive portion of said conduit for receiving heat from coolant in said thermally conductive portion of said conduit, so that coolant in a vapor state is cooled and changes to a liquid state;

a plurality of valves which each have an inlet and an outlet, said inlets of said valves are offset from each other so that at least one of said inlets is vertically lower than at least one other inlet of said inlets throughout all angles of a roll of the aircraft;

fluid communication structure providing fluid communication between said inlet of each said valve and said second portion of said conduit;

valve control structure responsive to the presence of coolant in a liquid state at the inlet to either said valve for opening that valve; and a discharge section communicating with said outlet of each said valve.

2. An apparatus according to claim 1, wherein said heat exchanger includes a further conduit having spaced first and second portions and a thermally conductive portion disposed therebetween, said second portion of said further conduit being vertically lower than said first portion thereof;

wherein said supply section supplies the coolant to said first portion of said further conduit, at least a portion of the coolant flowing from said first portion of said further conduit through said thermally conductive portion thereof to said second portion thereof; and wherein said thermally conductive structure has a further portion which is thermally coupled to said thermally conductive portion of said further conduit for receiving heat from coolant in said thermally conductive portion of said further conduit.

3. An apparatus according to claim 2, wherein said heat exchanger further includes two additional conduits which each have spaced first and second portions and a thermally conductive portion disposed therebetween, said second portion of each said additional conduit being vertically lower than said first portion thereof, and said supply section supplying coolant to said first portion of each said additional conduit, at least a portion of the coolant flowing from said first portion of each said additional conduit through said thermally conductive portion thereof to said second portion thereof;

wherein said additional conduits are coupled to each other and further coupled to at least one of said conduit and said further conduit;

wherein said thermally conductive structure has two additional portions which are each thermally coupled to said thermally conductive portion of a respective said additional conduit for receiving heat from coolant in said thermally conductive portion thereof; and wherein each said fluid communication structure is in fluid communication with said second portion of a respective said additional conduit.

4. An apparatus according to claim 3, wherein said supply section includes first, second and third sections, said first section supplying coolant to said second section, said second section supplying coolant to said third section, said third section supplying coolant to said first portions each of the said conduits which each have said second portion thereof in fluid communication said fluid communication structure.

5. An apparatus according to claim 3, wherein said fluid communication structure includes a plurality of collection conduits which each communicate with the inlet of at least one of said plurality of valves, said collection conduits offset from each other so that at least one of said collection conduits is vertically lower than at least one other collection conduit of said collection conduits throughout every angle of a roll performed by the aircraft.

6. An apparatus according to claim 5, wherein said heat exchanger is formed into a plurality of sets, each set including each of said conduits, and each set spaced from each other in an axial direction.

7. An apparatus according to claim 6, wherein each of the plurality of sets comprises one or more circular shaped conduits, each circular shaped conduit including each of said conduits.

8. An apparatus according to claim 6, wherein each of the plurality of sets includes one said fluid communication structure.

9. An apparatus according to claim 3, further including an elongate housing which extends approximately in an axial direction, and which has said heat exchanger therein.

10. An apparatus according to claim 3, wherein said portions of said thermally conductive structure each include a plurality of spaced fins.

11. An apparatus according to claim 10, wherein said heat exchanger includes vanes which are supported on said conduits and configured to cause air flowing approximately in a first direction to be redirected to flow past said fins approximately perpendicular to said first direction and to then be redirected again so as to flow approximately in said first direction.

* * * * *